US009277340B2

(12) United States Patent
Mizuta

(10) Patent No.: US 9,277,340 B2
(45) Date of Patent: Mar. 1, 2016

(54) SOUND OUTPUT SYSTEM, INFORMATION PROCESSING APPARATUS, COMPUTER-READABLE NON-TRANSITORY STORAGE MEDIUM HAVING INFORMATION PROCESSING PROGRAM STORED THEREIN, AND SOUND OUTPUT CONTROL METHOD

(71) Applicant: NINTENDO CO., LTD., Kyoto (JP)

(72) Inventor: Masato Mizuta, Kyoto (JP)

(73) Assignee: NINTENDO CO., LTC., Kyoto (JP)

( * ) Notice: Subject to any disclaimer, the term of this patent is extended or adjusted under 35 U.S.C. 154(b) by 431 days.

(21) Appl. No.: 13/868,450

(22) Filed: Apr. 23, 2013

(65) Prior Publication Data

US 2014/0079230 A1 Mar. 20, 2014

(30) Foreign Application Priority Data

Sep. 19, 2012 (JP) ..... 2012-206143

(51) Int. Cl.
*H04R 29/00* (2006.01)
*H04R 5/04* (2006.01)
*H04R 27/00* (2006.01)

(52) U.S. Cl.
CPC ..... *H04R 29/001* (2013.01); *H04R 5/04* (2013.01); *H04R 27/00* (2013.01); *H04R 2420/01* (2013.01); *H04R 2420/05* (2013.01); *H04R 2499/15* (2013.01)

(58) Field of Classification Search
USPC ..... 381/1, 17, 18, 59, 61, 74, 77, 79, 81, 381/82, 85, 104, 106–109, 300, 306, 307, 381/310, 311; 700/94
See application file for complete search history.

(56) References Cited

U.S. PATENT DOCUMENTS

| | | | | |
|---|---|---|---|---|
| 9,053,710 | B1 * | 6/2015 | Zehr et al. | |
| 2004/0049654 | A1 * | 3/2004 | Chrysanthakopoulos et al. | 712/35 |
| 2005/0113158 | A1 * | 5/2005 | Sterchi et al. | 463/3 |
| 2005/0117761 | A1 * | 6/2005 | Sato | 381/309 |
| 2008/0096660 | A1 * | 4/2008 | Ota | 463/39 |
| 2010/0056272 | A1 * | 3/2010 | Dutilly et al. | 463/30 |
| 2010/0083116 | A1 | 4/2010 | Akifusa et al. | |
| 2013/0041648 | A1 * | 2/2013 | Osman | 704/2 |
| 2013/0296044 | A1 * | 11/2013 | Fujii et al. | 463/30 |

FOREIGN PATENT DOCUMENTS

JP 2010-85868 4/2010

* cited by examiner

*Primary Examiner* — Vivian Chin
*Assistant Examiner* — Friedrich W Fahnert
(74) *Attorney, Agent, or Firm* — Nixon & Vanderhye PC

(57) ABSTRACT

In a sound output system including: an information processing apparatus; a first output device; and a second output device, the information processing apparatus generates, based on predetermined information processing, a first sound signal to be outputted to the first output device, and a second sound signal that is a sound signal to be outputted to the second output device and has a content different from that of the first sound signal. When headphones are connected to the second output device, the second sound signal is generated such that at least a part of a first sound which is not outputted as a second sound when no headphones are connected, is contained in the second sound, and the second sound is outputted from the headphones.

19 Claims, 13 Drawing Sheets

SOUND OUTPUT SYSTEM, INFORMATION PROCESSING APPARATUS, COMPUTER-READABLE NON-TRANSITORY STORAGE MEDIUM HAVING INFORMATION PROCESSING PROGRAM STORED THEREIN, AND SOUND OUTPUT CONTROL METHOD

CROSS REFERENCE TO RELATED APPLICATION

The disclosure of Japanese Patent Application No. 2012-206143, filed on Sep. 19, 2012, is incorporated herein by reference.

FIELD

The exemplary embodiments relate to a sound output system, an information processing apparatus, a computer-readable non-transitory storage medium having an information processing program stored therein, and a sound output control method, and more particularly to a sound output system, an information processing apparatus, a computer-readable non-transitory storage medium having an information processing program stored therein, and a sound output control method each of which allows a plurality of different sound output devices to be provided and headphones to be connectable to one of the sound output devices.

BACKGROUND AND SUMMARY

To date, sound reproduction devices capable of outputting a predetermined sound from loudspeakers have been known. As such sound reproduction devices, sound reproduction devices to which headphones are connectable, have been also known. In such a device to which headphones are connectable, an acoustic characteristic of a sound to be reproduced is changed according to whether or not the headphones are connected to the device. For example, when no headphones are connected (a sound is outputted from loudspeakers), an acoustic characteristic is adjusted so as to emphasize a bass sound, and when headphones are connected, a sound is outputted to the headphones without performing such an adjustment. In such a manner, an acoustic characteristic is changed according to whether or not headphones are connected.

In the sound reproduction device as described above, although an acoustic characteristic of a sound to be reproduced is changed according to whether or not headphones are connected, a content to be reproduced (for example, music to be reproduced) is not changed. An exemplary case is assumed where a plurality of sound reproduction devices are simultaneously used, and sounds representing different contents are outputted from loudspeakers of the sound reproduction devices, respectively. In such a case, when a user connects headphones to one of the sound reproduction devices, wears the headphones, and listens to a sound through the headphones, the user, who wears the headphones, cannot hear sounds outputted from (the loudspeakers) of the other sound reproduction devices, or merely can faintly hear the sounds even if the user can hear them at all.

Therefore, a feature of the exemplary embodiments is to make available a sound output system, an information processing apparatus, a computer-readable non-transitory storage medium having an information processing program stored therein, and a sound output control method each of which allows a user wearing headphones to listen to a sound as intended by a sound creator, even under a situation that, in a case where a sound composed by different sounds outputted from a plurality of sound output devices, respectively, being combined, is intended to be heard, the headphones are connected to one of the sound output devices, and the sound is heard through the headphones. In the description herein, the computer-readable storage medium may include, for example, a magnetic medium such as a flash memory, a ROM, and a RAM, or an optical medium such as a CD-ROM, a DVD-ROM, and a DVD-RAM.

The aforementioned feature can be attained by, for example, the following configurations.

A feature of the exemplary embodiment provides a sound output system that includes an information processing apparatus, a first output device having a first sound output section, and a second output device having a second sound output section. The information processing apparatus includes a sound generation section configured to generate, based on predetermined information processing, a first sound signal to be outputted to the first output device, and a second sound signal that is a sound signal to be outputted to the second output device and has a sound content different from that of the first sound signal. Further, the second output device includes: a headphone connection section configured to connect headphones; a second sound output control section configured to output, from the second sound output section, a second sound based on the second sound signal, and to output, when the headphones are connected to the headphone connection section, the second sound from the headphones; and a connection notification section configured to notify the information processing apparatus whether or not the headphones are connected. The sound generation section generates, when the connection notification section notifies that the headphones are connected to the second output device, the second sound signal such that at least a part of a first sound which is based on the first sound signal and is not outputted as the second sound when no headphones are connected, is contained in the second sound.

According to the feature described above, also when a player wears headphones, the player is allowed to hear a sound (a sound as is outputted when no headphones are connected) as intended by a sound creator.

Furthermore, the sound generation section may generate the first sound signal based on predetermine music data and generates the second sound signal based on predetermined sound effect data, when no headphones are connected to the second output device, and may generate, when the headphones are connected to the second output device, the second sound signal such that at least a part of a sound represented by the predetermined music data is contained in the second sound.

Furthermore, the first output device may further include a first display section, the second output device may further include a second display section, and the information processing apparatus may further include an image generation section configured to generate a first image to be displayed on the first display section, and a second image to be displayed on the second display section.

Furthermore, the second output device may further include an operation data generation section configured to generate operation data based on an operation performed by a player, and the information processing apparatus may further include a game processing section configured to perform a game process based on the operation data.

Furthermore, another feature of the exemplary embodiment provides a sound output system that includes an information processing apparatus, a first output device having a first sound output section, and a second output device having a second sound output section. The information processing apparatus includes a sound generation section configured to generate, based on predetermined information processing, a first sound signal to be outputted to the first output device, and a second sound signal that is a sound signal to be outputted to the second output device and has a sound content different from that of the first sound signal. The second output device includes: a headphone connection section configured to connect headphones; a second sound output control section configured to output, from the second sound output section, a second sound based on the second sound signal when no headphones are connected to the headphone connection section, and to output, when the headphones are connected to the headphone connection section, the second sound only from the headphones; and a connection notification section configured to notify the information processing apparatus whether or not the headphones are connected. The sound generation section generates a sound signal such that at least a part of a first sound which is based on the first sound signal and is not outputted as the second sound when no headphones are connected, is contained in the second sound, and generates a sound signal such that at least a part of the second sound which is not outputted as the first sound when no headphones are connected, is contained in the first sound, when the headphones are connected to the second output device.

According to the feature described above, also when a player is using headphones connected to the second output device, persons other than the player using the headphones are allowed to hear a sound as intended by a sound creator.

A still another feature of the exemplary embodiment provides a sound output system that includes an information processing apparatus, a first output device having a first sound output section, and a second output device having a second sound output section. The information processing apparatus includes a sound generation section configured to generate, based on predetermined information processing, a first sound signal to be outputted to the first sound output section, and a second sound signal that is a sound signal to be outputted to the second sound output section and has a sound content different from that of the first sound signal. The second output device includes: a headphone connection section configured to connect headphones; a second sound output control section configured to output, from the second sound output section, a second sound based on the second sound signal when no headphones are connected to the headphone connection section, and to output, when the headphones are connected to the headphone connection section, the second sound only from the headphones; and a connection notification section configured to notify the information processing apparatus whether or not the headphones are connected. The sound generation section generates, when the headphones are connected to the second output device, a sound signal such that a sound that is not contained in a first sound and a second sound which are outputted when no headphones are connected, is contained in the second sound.

According to the feature described above, a sound that can be heard by a player only when headphones are connected, can be provided. Therefore, for example, when a game process is executed, an entertaining characteristic of the game can be enhanced.

A still another feature of the exemplary embodiment provides an information processing apparatus capable of outputting a sound signal to a first output device having a first sound output section, and to a second output device having: a second sound output section; and a headphone connection section that connects headphones. The information processing apparatus includes: a connection detection section configured to determine, by detection, whether or not the headphones are connected to the second output device; and a sound generation section configured to generate, based on predetermined information processing, a first sound signal to be outputted to the first output device, and a second sound signal that is a sound signal to be outputted to the second output device and has a sound content different from that of the first sound signal. The sound generation section generates, when the headphones are connected to the second output device, the second sound signal such that at least a part of a first sound which is based on the first sound signal and is not outputted from the second sound output section when no headphones are connected, is contained in a second sound based on the second sound signal.

Furthermore, a still another feature of the exemplary embodiment provides an information processing apparatus capable of outputting a sound signal to a first output device having a first sound output section, and to a second output device having: a second sound output section; and a headphone connection section that connects headphones. The information processing apparatus includes: a connection detection section configured to determine, by detection, whether or not the headphones are connected to the second output device; and a sound generation section configured to generate, based on predetermined information processing, a first sound signal to be outputted to the first output device, and a second sound signal that is a sound signal to be outputted to the second output device and has a sound content different from that of the first sound signal. The sound generation section generates a sound signal such that at least a part of a first sound which is based on the first sound signal and is not outputted as a second sound based on the second sound signal when no headphones are connected, is contained in the second sound, and generates a sound signal such that at least a part of the second sound which is not outputted as the first sound when no headphones are connected, is contained in the first sound, when the headphones are connected to the second output device.

Furthermore, a still another feature of the exemplary embodiment provides an information processing apparatus capable of outputting a sound signal to a first output device having a first sound output section, and to a second output device having: a second sound output section; and a headphone connection section that connects headphones. The information processing apparatus includes: a connection detection section configured to determine, by detection, whether or not the headphones are connected to the second output device; and a sound generation section configured to generate, based on predetermined information processing, a first sound signal to be outputted to the first output device, and a second sound signal that is a sound signal to be outputted to the second output device and has a sound content different from that of the first sound signal. The sound generation section generates, when the headphones are connected to the second output device, a sound signal such that a sound that is not contained in a first sound and a second sound which are outputted when no headphone are connected, is contained in the second sound.

According to the exemplary embodiment, when a sound is composed by different sounds outputted from a plurality of sound output devices, respectively, being combined, a player is allowed to hear a sound as intended by a sound creator in both a case where headphones are worn and a case where headphones are not worn.

DETAILED DESCRIPTION OF NON-LIMITING EXAMPLE EMBODIMENTS

Figure 1:
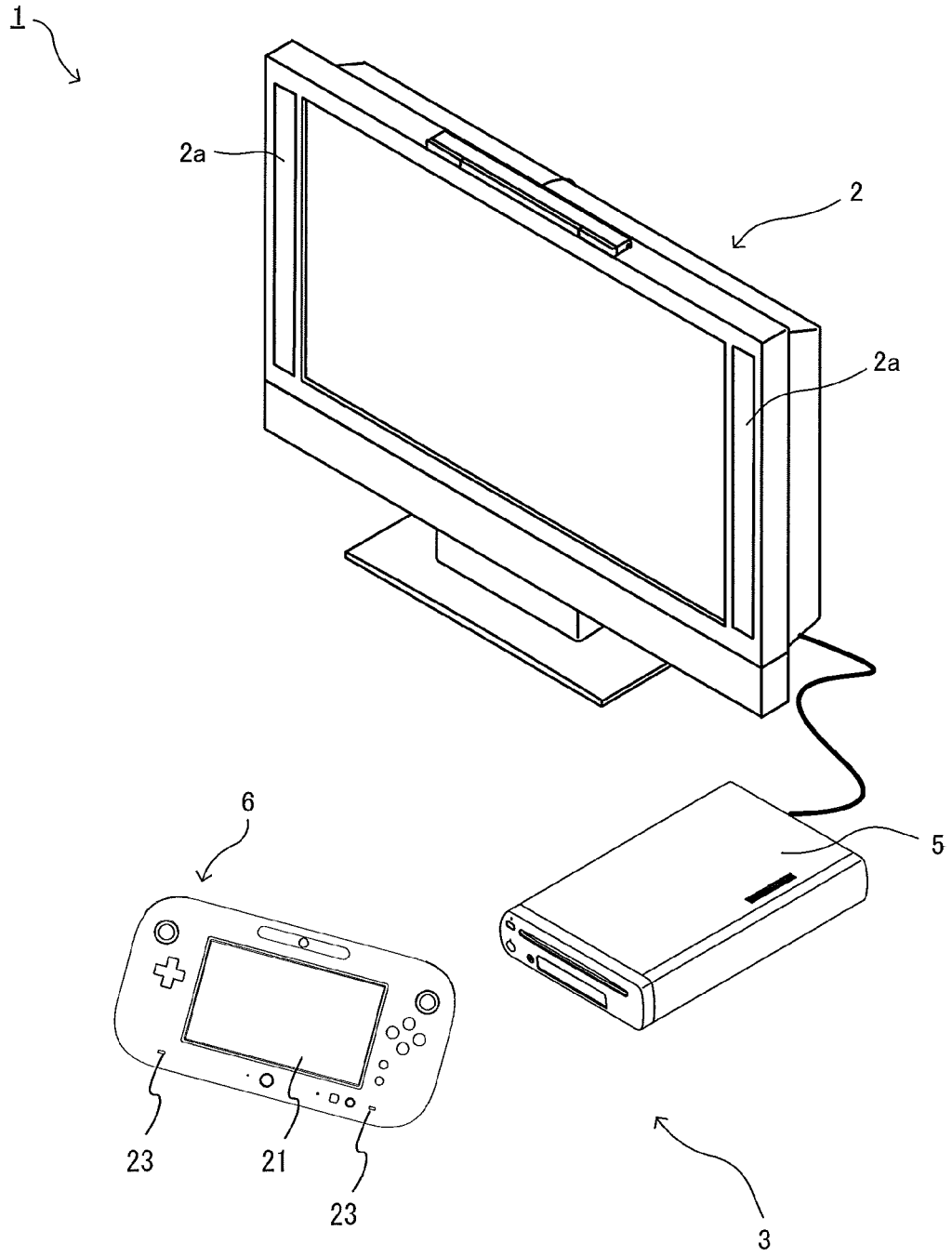
FIG. 1 is an external view of an example of a game system 1 according to an exemplary embodiment.

With reference to FIG. 1, a game system according to an exemplary embodiment will be described.

As shown in FIG. 1, a game system 1 includes a household television receiver (hereinafter, referred to as a monitor) 2 that is an example of display means, and a stationary game apparatus 3 connected to the monitor 2 via a connection cord. The monitor 2 includes loudspeakers 2*a*. The game apparatus 3 includes a game apparatus body 5 and a terminal device 6.

The monitor 2 displays a game image outputted from the game apparatus body 5. The monitor 2 includes the loudspeakers 2*a*, and the loudspeakers 2*a* each output a game sound outputted from the game apparatus body 5. In this exemplary embodiment, the monitor 2 includes the loudspeakers 2*a*. In another exemplary embodiment, external loudspeakers may be separately provided so as to be connected to the monitor 2.

The game apparatus body 5 executes a game process and the like based on a game program or the like stored in an optical disc that is readable by the game apparatus body 5.

The terminal device 6 is an input device that is small enough to be held by a user. The user is allowed to move the terminal device 6 with hands, or place the terminal device 6 at any location when the terminal device 6 is used. The terminal device 6 includes an LCD (Liquid Crystal Display) 21 as display means, loudspeakers 23, a headphone jack described below, input means (analog sticks, press-type buttons, a touch panel, and the like), and the like. The terminal device 6 and the game apparatus body 5 are communicable with each other wirelessly (or via a cable). The terminal device 6 receives, from the game apparatus body 5, data of an image (e.g., a game image) generated in the game apparatus body 5, and displays the image represented by the data on the LCD 21. Further, the terminal device 6 receives, from the game apparatus body 5, data of a sound (e.g., a sound effect, BGM, or the like of a game) generated in the game apparatus body 5, and outputs the sound represented by the data from the loudspeakers 23 or from headphones in the case of the headphones being connected to the terminal device 6. Further, the terminal device 6 transmits, to the game apparatus body 5, operation data representing the content of an operation performed on the terminal device 6.

Figure 2:
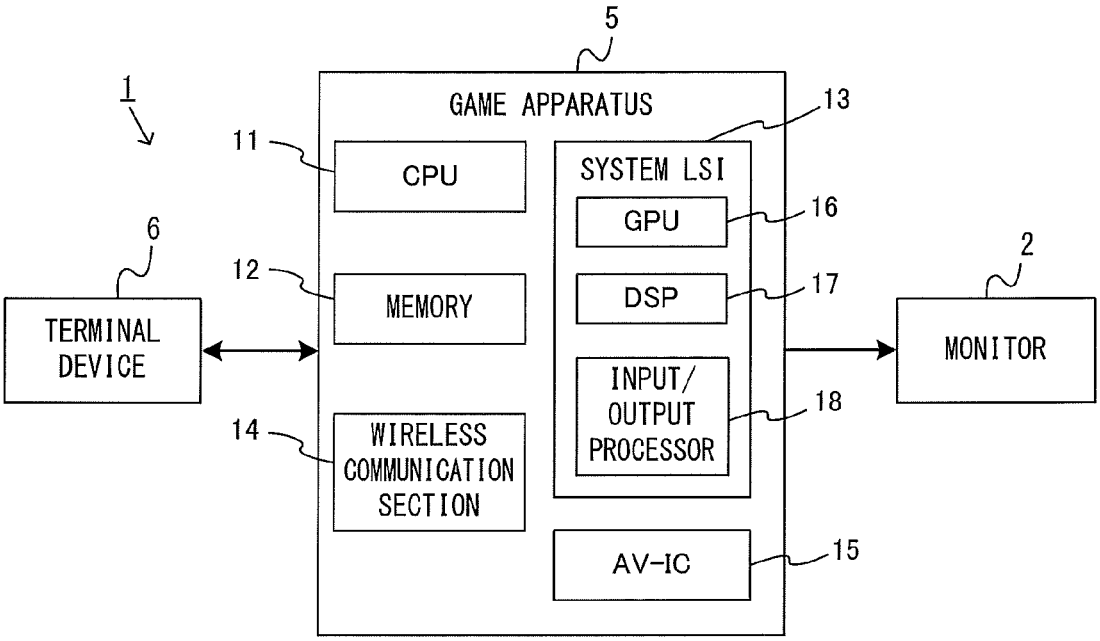
FIG. 2 is a functional block diagram illustrating an example of a game apparatus body 5 shown in FIG. 1.

FIG. 2 is a block diagram illustrating the game apparatus body 5. In FIG. 2, the game apparatus body 5 is an example of an information processing apparatus. In the exemplary embodiment, the game apparatus body 5 includes a CPU (control section) 11, a memory 12, a system LSI 13, a wireless communication section 14, an AV-IC (Audio Video-Integrated Circuit) 15, and the like.

The CPU 11 executes a predetermined information processing program by using the memory 12, the system LSI 13, and the like. Thereby, various functions (e.g., game process) in the game apparatus 3 are realized.

The system LSI 13 includes a GPU (Graphics Processor Unit) 16, a DSP (Digital Signal Processor) 17, an input/output processor 18, and the like.

The GPU 16 generates an image in accordance with a graphics command (draw command) from the CPU 11. In the exemplary embodiment, the game apparatus body 5 may generate both a game image to be displayed on the monitor 2 and a game image to be displayed on the terminal device 6. Hereinafter, the game image to be displayed on the monitor 2 may be referred to as a "monitor game image", and the game image to be displayed on the terminal device 6 may be referred to as a "terminal game image".

The DSP 17 serves as an audio processor, and generates sound data by using sound data and sound waveform (tone quality) data stored in the memory 12. In the exemplary embodiment, similarly to the game images, both a game sound to be outputted from the loudspeakers 2*a* of the monitor 2 and a game sound to be outputted from the loudspeakers 23 of the terminal device 6 or the headphones may be generated. Hereinafter, the game sound to be outputted from the monitor 2 may be referred to as a "monitor game sound", and the game sound to be outputted from the terminal device 6 may be referred to as a "terminal game sound".

The input/output processor 18 executes transmission and reception of data with the terminal device 6 via the wireless communication section 14. In the exemplary embodiment, the input/output processor 18 transmits data of the game image (terminal game image) generated by the GPU 16 and data of the game sound (terminal game sound) generated by the DSP 17, via the wireless communication section 14 to the terminal device 6. At this time, the terminal game image may be compressed and transmitted so as to avoid a delay in the display image. In addition, the input/output processor 18 receives, via the wireless communication section 14, operation data and the like transmitted from the terminal device 6, and (temporarily) stores the data in a buffer region of the memory 12.

Of the images and sounds generated in the game apparatus body 5, the image data and sound data to be outputted to the monitor 2 are read by the AV-IC 15. Through an AV connector that is not shown, the AV-IC 15 outputs the read image data to the monitor 2, and outputs the read sound data to the loudspeakers 2*a* included in the monitor 2. Thereby, an image is displayed on the monitor 2, and a sound is outputted from the loudspeakers 2*a*.

Figure 3:
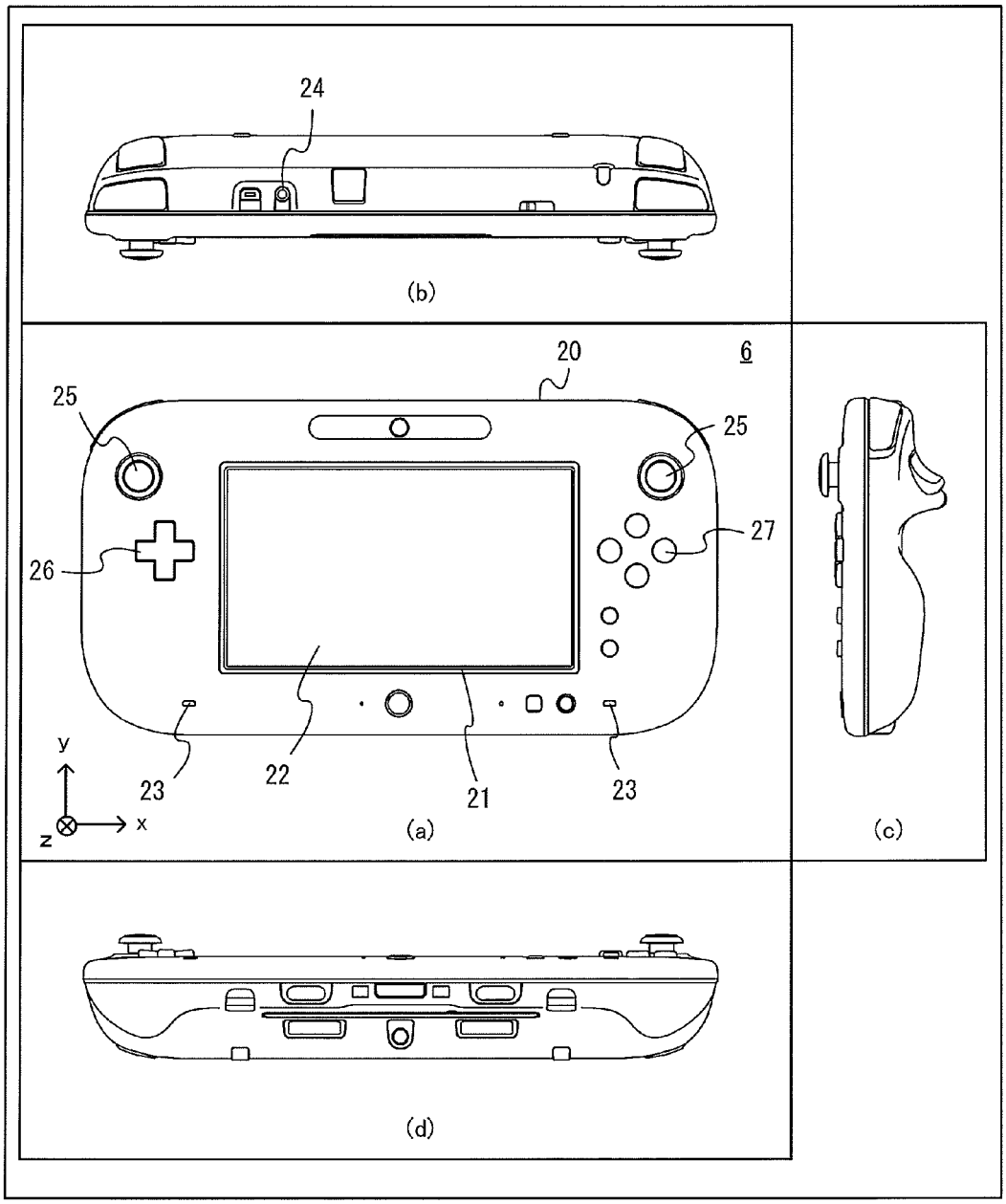
FIG. 3 illustrates a non-limiting exemplary external structure of a terminal device 6 shown in FIG. 1.

FIG. 3 illustrates a non-limiting exemplary external structure of the terminal device 6. As shown in FIG. 3, the terminal device 6 includes a roughly plate-shaped housing 20. The size (shape) of the housing 20 is small enough to be held by a user with both hands or one hand. Further, the terminal device 6 includes the LCD 21 as an example of a display section. The above-mentioned terminal game image is displayed on the LCD 21.

The terminal device 6 includes the loudspeakers 23. The terminal game sound is outputted from the loudspeakers 23. Further, the terminal device 6 includes a headphone jack 24, and given types of headphones can be plugged into or out of the headphone jack 24. The terminal device 6 outputs a sound from the loudspeakers 23 when no headphones are connected to the headphone jack. However, when headphones are connected to the headphone jack, no sound is outputted from the loudspeakers 23. Namely, in the exemplary embodiment, sounds are not simultaneously outputted from the loudspeakers 23 and headphones. That is, one of the output of a sound from the loudspeakers 23 and the output of a sound from the headphones is exclusively performed (however, in another exemplary embodiment, both of these outputs may be simultaneously performed). In the exemplary embodiment, a process of changing a content of the terminal game sound according to whether or not headphones are connected to the terminal device 6, is performed. This process will be described below in detail.

In the exemplary embodiment, the terminal device 6 and the headphones are connected to each other via a cable by using, for example, the headphone jack 24 as described above. However, in another exemplary embodiment, the terminal device 6 and the headphones may be wirelessly connected to each other.

The terminal device 6 includes a touch panel 22. The touch panel 22 is an example of a position detection section for detecting a position of an input performed on a predetermined input surface (a screen of the display section) provided on the housing 20. Further, the terminal device 6 includes, as an operation section (an operation section 31 shown in FIG. 4), analog sticks 25, a cross key 26, buttons 27, and the like.

Figure 4:
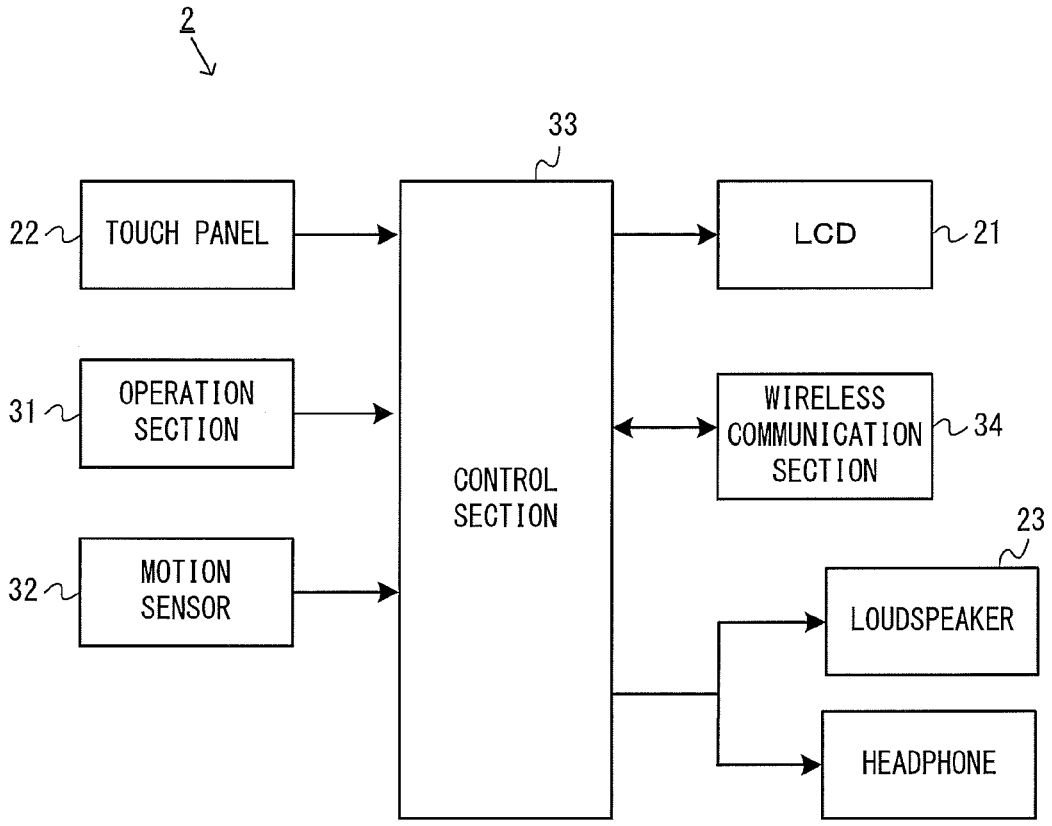
FIG. 4 is a block diagram illustrating a non-limiting exemplary internal structure of the terminal device 6.

FIG. 4 is a block diagram illustrating a non-limiting exemplary electrical configuration of the terminal device 6. As shown in FIG. 4, the terminal device 6 includes the above-mentioned LCD 21, the touch panel 22, the loudspeakers 23, and the operation section 31. Further, headphones are connectable to the terminal device 6 via the headphone jack 24. Further, the terminal device 6 includes a motion sensor 32 (e.g., an acceleration sensor or a gyro sensor) for detecting an orientation of the terminal device 6.

The terminal device 6 includes a wireless communication section 34 capable of wirelessly communicating with the game apparatus body 5. In the exemplary embodiment, wireless communication is performed between the terminal device 6 and the game apparatus body 5. In another exemplary embodiment, wired communication may be performed.

The terminal device 6 includes a control section 33 for controlling operations in the terminal device 6. Specifically, the control section 33 receives output data from the respective input sections (the touch panel 22, the operation section 31, and the motion sensor 32), and transmits the output data as operation data via the wireless communication section 34 to the game apparatus body 5. Further, the control section 33 determines, by detection, whether or not the headphone jack 24 is in a connected state, and transmits, to the game apparatus body 5, data (determination result) representing the connection state (whether the headphone jack 24 is in a connected state or a non-connected state) as a part of the operation data. When the terminal game image from the game apparatus body 5 is received by the wireless communication section 34, the control section 33 performs, according to need, appropriate processes (e.g., decompression if the image data is compressed), and causes the LCD 21 to display the image from the game apparatus body 5. Further, when the terminal game sound from the game apparatus body 5 is received by the wireless communication section 34, the control section 33 outputs the terminal game sound to the loudspeakers 23 when no headphones are connected, and outputs, when headphones are connected, the terminal game sound to the headphones.

Next, an outline of a process executed by the system of the exemplary embodiment will be described with reference to FIG. 5 and FIG. 6.

In the exemplary embodiment, a case is assumed where a predetermined game process is executed. In the game, predetermined BGM and a predetermined sound effect are reproduced, as appropriate, as sounds for the game. A case is assumed where, in a state where no headphones are connected to the terminal device 6 (in a normal play state), the BGM is outputted only from the loudspeakers 2*a* of the monitor 2, and the sound effect is outputted only from the loudspeakers 23 of the terminal device 6. FIG. 5 schematically illustrates non-limiting exemplary sound outputs of the monitor 2 and the terminal device 6 in such a normal play state. BGM and a sound effect are outputted from two sound output devices (the loudspeakers of the monitor and the loudspeakers of the terminal device), respectively, for, for example, the following reasons. Namely, if BGM is outputted from both the loudspeakers 2*a* of the monitor 2 and the loudspeakers 23 of the terminal device 6, a delay in a video/audio output may occur in the monitor 2 depending on a performance of the monitor 2 (for example, a monitor having a function of processing or correcting an image or a sound outputted by the game apparatus body 5), and a time lag may occur between a sound output from the monitor 2 and a sound output from the terminal device 6. In such a case, the BGM may be heard by a player in an uncomfortable manner. Further, in a case where, for example, a player performs a game operation by mainly viewing the LCD 21 of the terminal device 6, when the terminal device 6 is caused to output only a sound effect, a player can easily concentrate on a game play. In consideration of these situations, it is sufficient if BGM is outputted from one of the monitor 2 or the terminal device 6, and the BGM need not be outputted from both the monitor 2 and the terminal device 6 (the same can apply to a sound effect). Therefore, in the normal play state, a process may be performed such that BGM is outputted only from the loudspeakers 2*a* of the monitor 2, and a sound effect is outputted only from the loudspeakers 23 of the terminal device 6.

Figure 5:
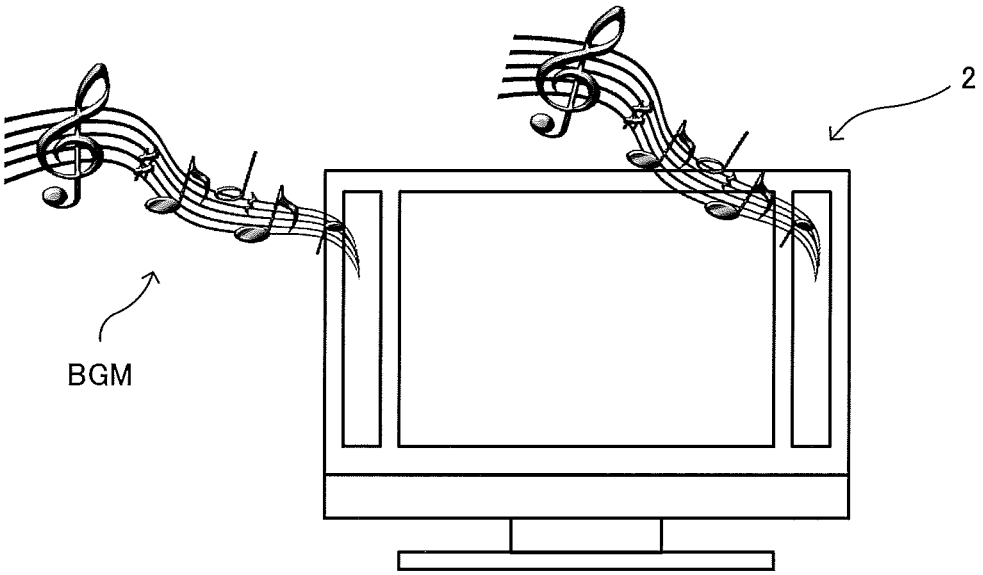
FIG. 5 illustrates a non-limiting exemplary state where a game sound is outputted.
Figure 5:
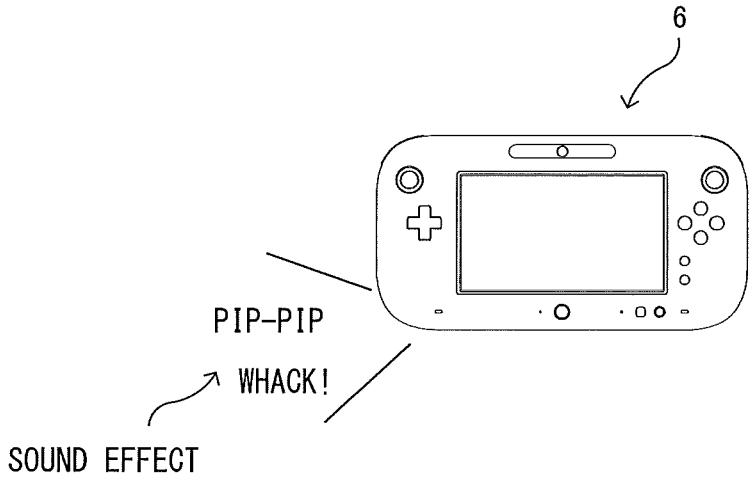
Figure 6:
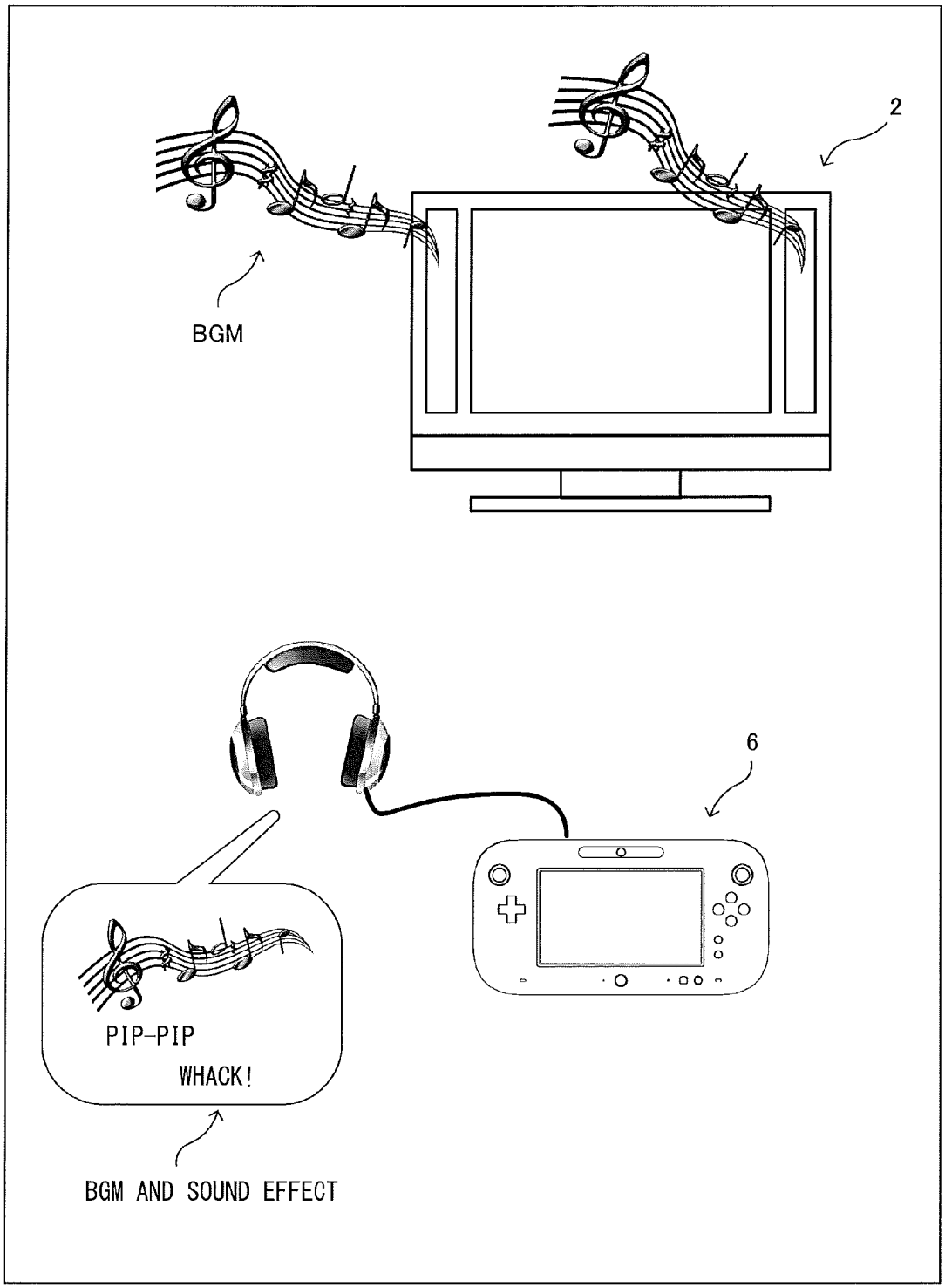
FIG. 6 illustrates a non-limiting exemplary state where a game sound is outputted.

It is assumed that, in a state shown in FIG. 5, a player connects headphones to the terminal device 6. In this case, as shown in FIG. 6, in the terminal device 6, a sound is not outputted from the loudspeakers 23, and a sound is outputted from the headphones. From the headphones, the same BGM as outputted from the monitor 2, in addition to the sound effect, is outputted. Namely, although only the sound effect is outputted from the terminal device 6 when no headphones are connected to the terminal device 6, both the BGM and the sound effect are outputted from the terminal device 6 when headphones are connected. This is because a player who wears the headphones cannot clearly hear a sound (BGM) outputted from the monitor 2 (or the player cannot hear the outputted sound (BGM) at all). Therefore, when the headphones are connected to the terminal device 6, the BGM is also outputted from the terminal device 6. Thus, also when a player wears the headphones, the player can continue to play a game while enjoying hearing the BGM. Further, for example, some users demand to hear BGM with an improved sound quality by using high-quality headphones called high-end headphones, and such a demand can be responded to.

Next, an operation of the system 1 for realizing the game process as described above will be described in detail with reference to FIG. 7 to FIG. 11.

Figure 7:
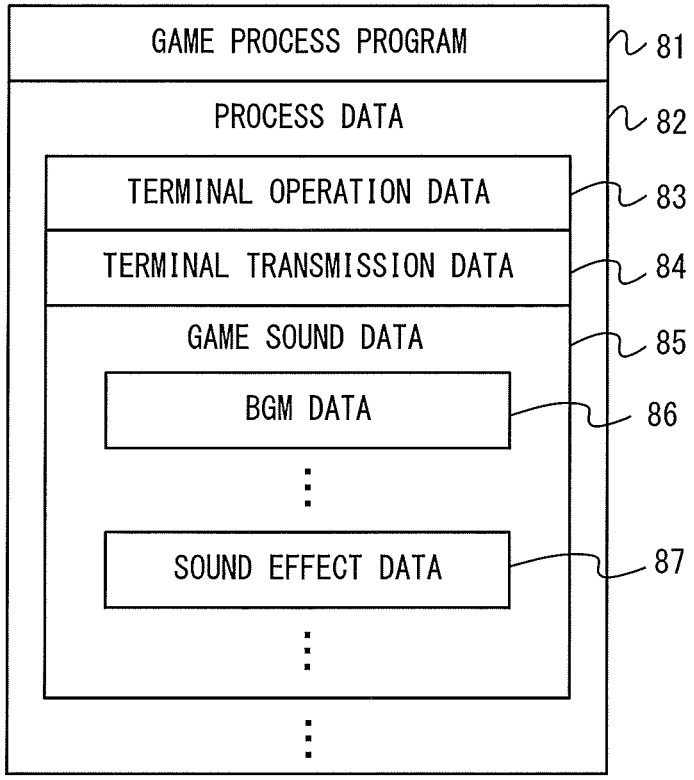
FIG. 7 illustrates a non-limiting exemplary memory map of a memory 12.

FIG. 7 illustrates non-limiting examples of various data that is stored in the memory 12 of the game apparatus body 5 when the game is executed.

A game process program 81 is a program for causing the CPU 11 of the game apparatus body 5 to execute a game process for realizing the game. The game process program 81 is loaded, for example, from an optical disc to the memory 12.

Process data 82 is data used in the game process executed by the CPU 11. The process data 82 includes terminal operation data 83, terminal transmission data 84, game sound data 85, and the like.

Figure 8:
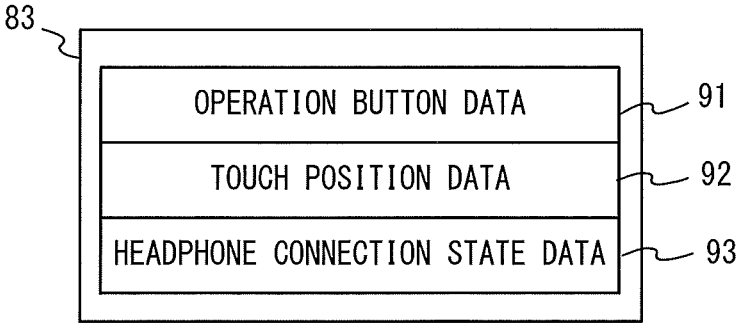
FIG. 8 illustrates a non-limiting exemplary structure of terminal operation data 83.

The terminal operation data 83 is operation data that is periodically transmitted from the terminal device 6. FIG. 8 illustrates a non-limiting exemplary structure of the terminal operation data 83. The terminal operation data 83 includes operation button data 91, touch position data 92, headphone connection state data 93, and the like. The operation button data 91 is data representing a state of an input to the operation section 31 (the analog sticks 25, the cross key 26, and the buttons 27). Further, the operation button data 91 also represents a content of an input to the motion sensor 32. The touch position data 92 is data representing a position (touch position) at which an input is performed on an input surface of the touch panel 22. The headphone connection state data 93 is data indicating whether or not headphones are connected to the headphone jack 24.

The terminal transmission data 84 is data that is periodically transmitted to the terminal device 6. The terminal transmission data 84 represents the terminal game image and the terminal game sound.

The game sound data 85 is data based on which the terminal game sound and the monitor game sound are generated. The game sound data 85 includes BGM data 86 representing at least one piece of BGM, and sound effect data 87 representing at least one sound effect. The BGM data 86 and the sound effect data 87 may be in the form of an audio file in, for example, an ADPCM format or an MP3 format, or may be, for example, in the form of musical score data that can be played by using a sound source incorporated in the game apparatus body 5.

Next, a flow of the game process that is executed by the CPU 11 of the game apparatus body 5 based on the game process program 81 will be described with reference to flow charts shown in FIG. 9 and FIG. 10.

Figure 9:
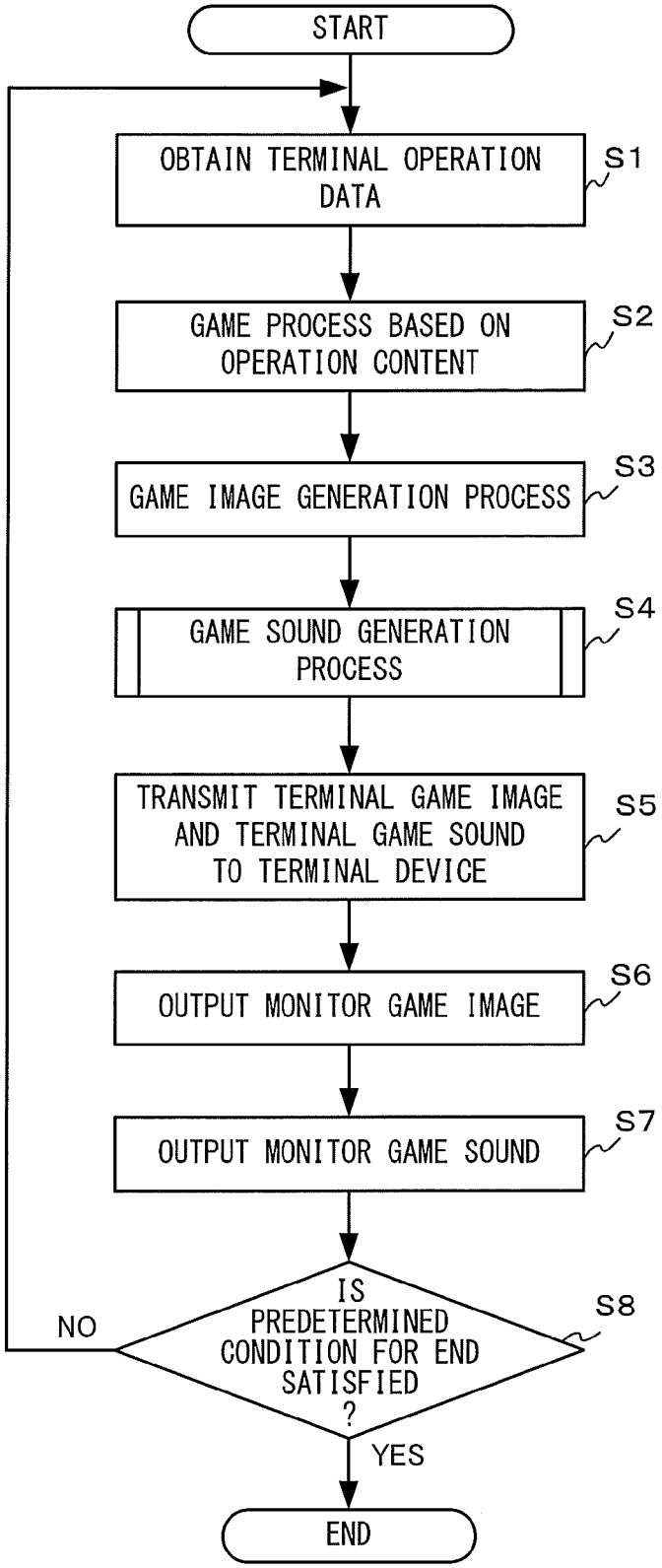
FIG. 9 is a flow chart showing a flow of a game process based on a game process program 81.
Figure 10:
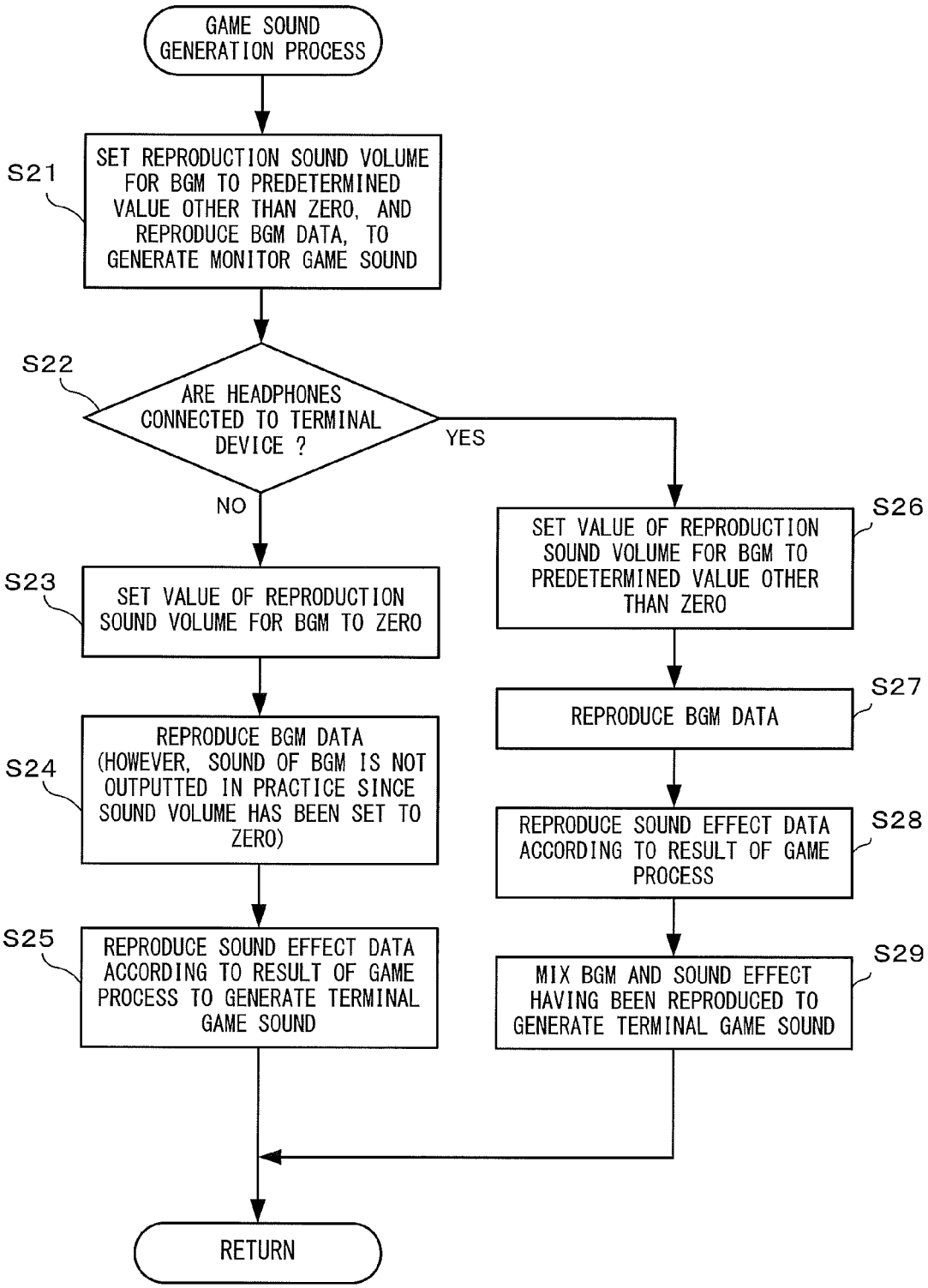
FIG. 10 is a flow chart showing in detail a non-limiting exemplary game sound generation process shown in FIG. 9.

When execution of the game process program 81 is started, a predetermined initialization process is performed, and then in step S1 of FIG. 9, the CPU 11 obtains the terminal operation data 83.

Next, in step S2, the CPU 11 executes a predetermined game process based on operation contents (operation contents represented mainly by the operation button data 91 and the touch position data 92) represented by the terminal operation data 83. For example, various characters such as a player character and the like or objects are moved, or a hit detecting process, a score addition process, or the like is performed.

Next, in step S3, the CPU 11 executes a process of generating a game image based on the result of the game process. For example, a virtual game space obtained after the player character has been moved based on the operation content, is captured by a virtual camera, to generate a game image. At this time, the CPU 11 generates two images, that is, the monitor game image and the terminal game image, as appropriate, according to a game content. For example, the images are generated by using two virtual cameras, respectively.

Next, in step S4, the CPU 11 executes a game sound generation process for generating the monitor game sound and the terminal game sound. FIG. 10 is a flow chart showing in detail a non-limiting exemplary game sound generation process of step S4. In FIG. 10, initially, in step S21, the CPU 11 performs a process of generating the monitor game sound. Specifically, the CPU 11 sets a reproduction sound volume for BGM to a predetermined value other than zero, and reproduces the BGM data 86 as a sound for the monitor, to generate the monitor game sound.

Next, in step S22, the CPU 11 determines, with reference of the headphone connection state data 93 of the terminal operation data 83, whether or not headphones are connected to the terminal device 6. The result of the determination indicates that no headphones are connected (NO in step S22), the CPU 11 performs a process of outputting only a sound effect from the loudspeakers 23 of the terminal device 6. Namely, in step S23, the CPU 11 sets a reproduction sound volume for the BGM to zero. Next, in step S24, the BGM data 86 is reproduced as a sound for the terminal device. However, since the reproduction sound volume has been set to zero, the sound for BGM is not outputted in practice. Next, in step S25, the CPU 11 reproduces the sound effect data 87 for a predetermined sound effect, according to a result of the game process executed in step S2, to generate the terminal game sound (a reproduction sound volume for the sound effect is set to a predetermined value other than zero).

On the other hand, when the result of the determination in step S22 indicates that headphones are connected to the terminal device 6 (YES in step S22), the CPU 11 performs a process of outputting both the BGM and the sound effect from the headphones. Namely, in step S26, the CPU 11 sets a value of a reproduction sound volume for the BGM to a predetermined value (a sound volume value that is great enough for a player to hear the sound) other than zero. Next, in step S27, the CPU 11 reproduces the BGM data 86 as a sound for the terminal device. Further, in step S28, the CPU 11 reproduces the sound effect data 87 for a predetermined sound effect according to a result of the game process. In step S29, the CPU 11 mixes the BGM and the sound effect having been reproduced, to generate the terminal game sound. This is the end of the game sound generation process. The reproduction of the BGM for the monitor in step S21 may be performed simultaneously when the BGM for the terminal device is reproduced in step S24 or step S27. Namely, the BGM is reproduced, and output of the BGM as the sound for the monitor with a sound volume other than zero, and output of the BGM as the sound for the terminal device with a sound volume that is set according to whether or not the headphones are connected, may be simultaneously performed.

The method for generating the game sound as described above is an exemplary one. The method for generating the game sound is not limited thereto. Any process and method by which a sound of BGM as well as a sound effect can be outputted from headphones when the headphones are connected to the terminal device 6, and the sound for the BGM is not outputted from the terminal device 6 when no headphones are connected to the terminal device 6, may be used. For example, instead of an adjustment of the reproduction sound volume in the BGM reproduction process as described above being performed to implement the method for generating the game sound, the BGM reproduction process may not be executed when the terminal game sound is generated, in the case of no headphones being connected to the terminal device 6, to implement the method for generating the game sound.

Returning to FIG. 9, subsequent to the game sound generation process, in step S5, the CPU 11 stores, in the terminal transmission data 84, the terminal game image generated in step S3, and the terminal game sound generated in step S4, and transmits the terminal transmission data 84 to the terminal device 6. In the exemplary embodiment described herein, for convenience in description, a transmission cycle period for the terminal game sound is the same as a transmission cycle period for the terminal game image. However, in another exemplary embodiment, the transmission cycle period for the terminal game sound may be shorter than the transmission cycle period for the terminal game image. For example, the terminal game image may be transmitted every 1/60 seconds, and the terminal game sound may be transmitted every 1/180 seconds.

Next, in step S6, the CPU 11 outputs, to the monitor 2, the monitor game image generated in step S3. Subsequent thereto, in step S7, the CPU 11 outputs, to the loudspeakers 2*a*, the monitor game sound generated in step S4. The monitor game sound may be also outputted at a cycle period shorter than an output cycle period for the monitor game image.

Next, in step S8, the CPU 11 determines whether or not a predetermined condition for ending the game process is satisfied. When the result of the determination indicates that the predetermined condition is not satisfied (NO in step S8), the process is returned to step S1, and the process steps described above are repeated. When the predetermined condition is satisfied (YES in step S8), the CPU 11 ends the game process.

Figure 11:
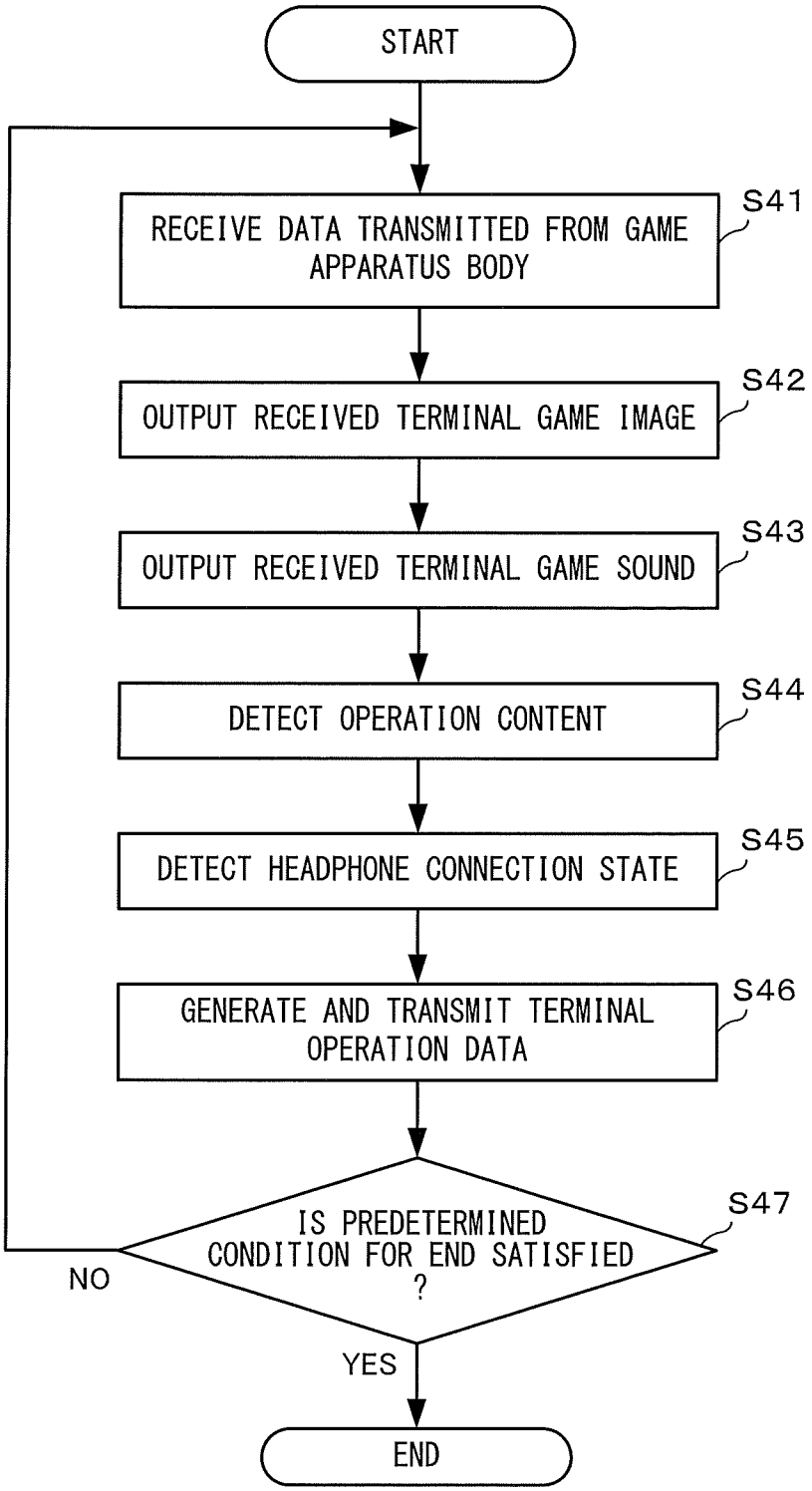
FIG. 11 is a flow chart showing a flow of a non-limiting exemplary control process for the terminal device 6.

Next, a flow of a control process executed by the control section 33 of the terminal device 6 will be described with reference to a flow chart of FIG. 11. Initially, in step S41, the control section 33 receives the terminal transmission data 84 transmitted from the game apparatus body 5.

Next, in step S42, the control section 33 outputs, to the LCD 21, the terminal game image contained in the terminal transmission data 84 having been received.

Next, in step S43, the control section 33 outputs the terminal game sound contained in the terminal transmission data 84 having been received such that the terminal game sound is outputted to the loudspeakers 23 when no headphones are connected, and the terminal game sound is outputted to headphones when the headphones are connected.

Next, in step S44, the control section 33 detects for an input (operation content) on the operation section 31, the motion sensor 32, or the touch panel 22, to generate the operation button data 91 and the touch position data 92.

Next, in step S45, the control section 33 determines, by detection, whether or not headphones are connected to the headphone jack 24. The control section 33 generates, as the headphone connection state data 93, data indicating whether or not the headphones are connected.

Next, in step S46, the control section 33 generates the terminal operation data 83 containing the operation button data 91, the touch position data 92, and the headphone connection state data 93 generated in step S44 or step S45, and transmits the terminal operation data 83 to the game apparatus body 5.

Next, in step S47, the control section 33 determines whether or not a predetermined condition for ending a process of controlling the terminal device 6 is satisfied (for example, whether or not an operation of causing a power supply to be off has been performed). As a result, it is determined that the predetermined condition is not satisfied (NO in step S47), the process is returned to step S41, and the process steps described above are repeated. When the predetermined condition is satisfied (YES in step S47), the control section 33 ends the process of controlling the terminal device 6.

As described above, in the exemplary embodiment, a first sound (the monitor game sound) is outputted from the loudspeakers 2*a* of the monitor 2, and a second sound (the terminal game sound) is outputted from the terminal device 6. When no headphones are connected to the terminal device 6, the first sound is not outputted from (the loudspeakers 23 of) the terminal device 6, whereas when headphones are connected to the terminal device 6, the first sound is also outputted from the headphones. Thus, in a case where sounds (the first sound and the second sound) representing different contents, are outputted from different loudspeakers (in the exemplary embodiment, the loudspeakers 2*a* of the monitor 2 and the loudspeakers 23 of the terminal device 6) to compose one sound (in the exemplary embodiment, BGM+sound effect, or the like), even a player wearing headphones can hear the sound of the BGM+the sound effect through the headphones, and the player is allowed to hear a sound as intended by a game creator.

[Modifications]

As the first sound (the BGM in the exemplary embodiment) to be outputted when headphones are connected to the terminal device 6, the entirety or a part of the first sound may be outputted. For example, in a case where the BGM is composed of three parts, that is, a melody part, a bass part, and a drum part, only the melody part may be outputted as the first sound to be outputted when headphones are connected to the terminal device 6. Alternatively, in a case where, for example, two different pieces of music (BGM) are simultaneously outputted as the first sound, one of the two pieces of music may be outputted as the first sound to be outputted when headphones are connected to the terminal device 6.

Furthermore, although, in the exemplary embodiment, a combination of BGM and a sound effect is used such that contents of sounds outputted from the different loudspeakers represent the BGM and the sound effect, respectively, a combination of the contents of the sounds may not be limited to such a combination. To any combination of sounds which enables satisfaction of a condition that, when headphones are connected to the terminal device 6, at least a part of the first sound to be outputted only from the monitor 2 side in the case of no headphones being connected to the terminal device 6, is outputted from the headphones, the process as described in the exemplary embodiment is applicable.

Figure 12:
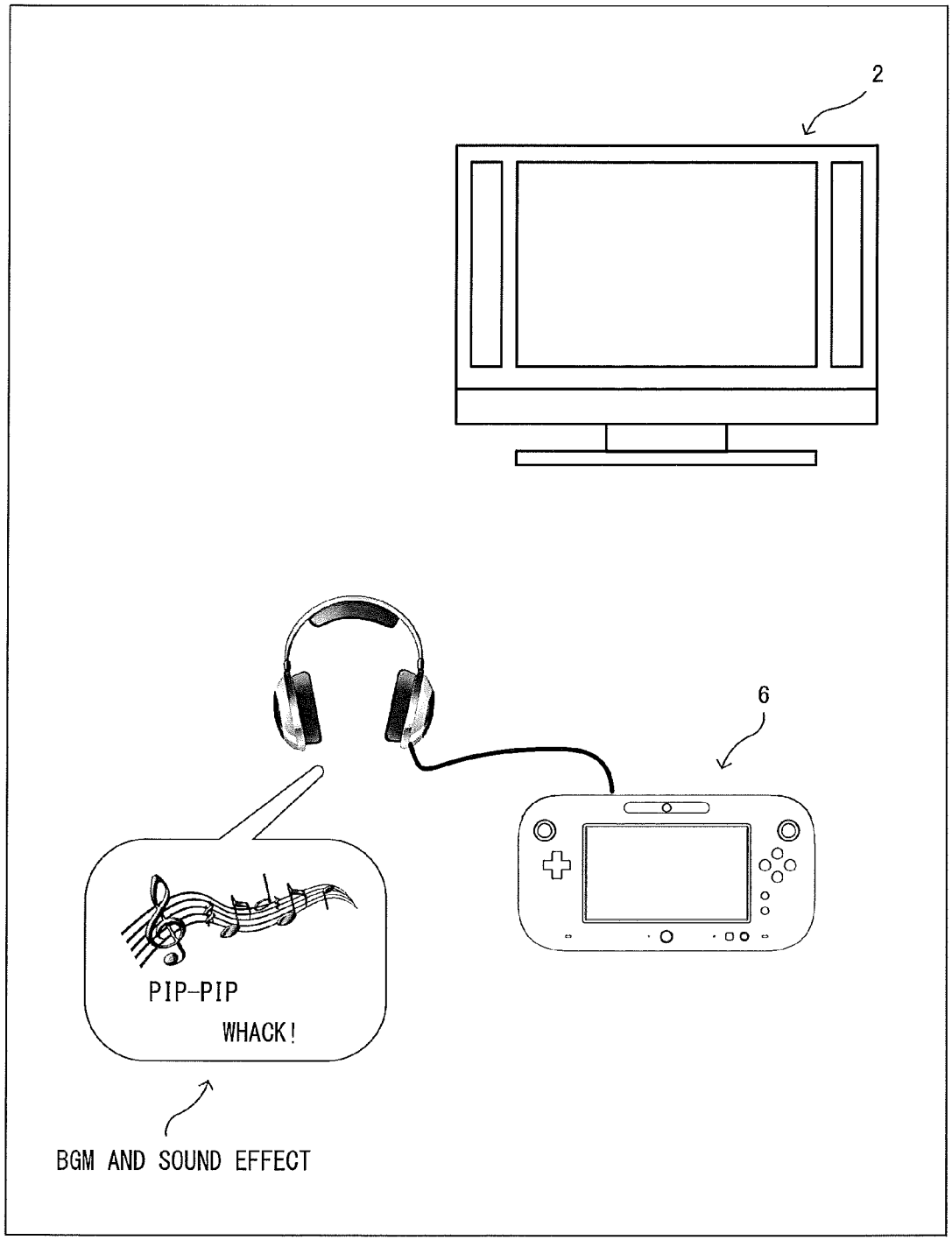
FIG. 12 illustrates a non-limiting exemplary state where a game sound is outputted.

In the exemplary embodiment, the first sound (BGM) is outputted from the monitor 2 side also when headphones are connected to the terminal device 6. However, for example, as shown in FIG. 12, the first sound may not be outputted from the monitor 2 when headphones are connected to the terminal device 6.

Figure 13:
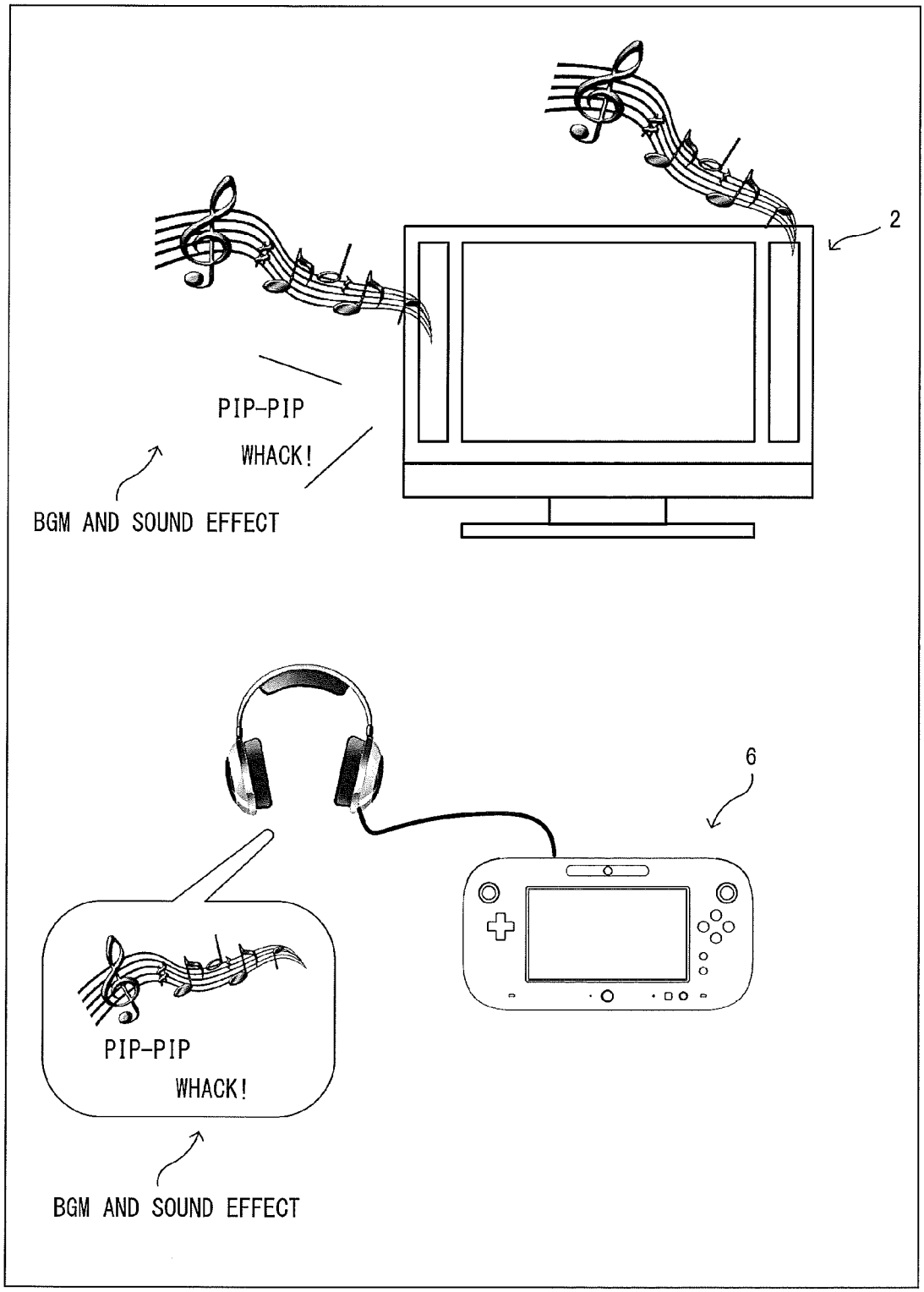
FIG. 13 illustrates a non-limiting exemplary state where a game sound is outputted.

Furthermore, as shown in FIG. 13, when headphones are connected to the terminal device 6, the sound effect may be also outputted from the monitor 2. This is advantageous in that, although, when headphones are connected to the terminal device 6, persons other than a player operating the terminal device 6 cannot hear the sound effect that has been heard through the terminal device 6 until then, the persons other than the player can continuously hear the sound effect (through the loudspeakers 2*a* of the monitor 2) (this is particularly advantageous when multiple players play the game).

Figure 14:
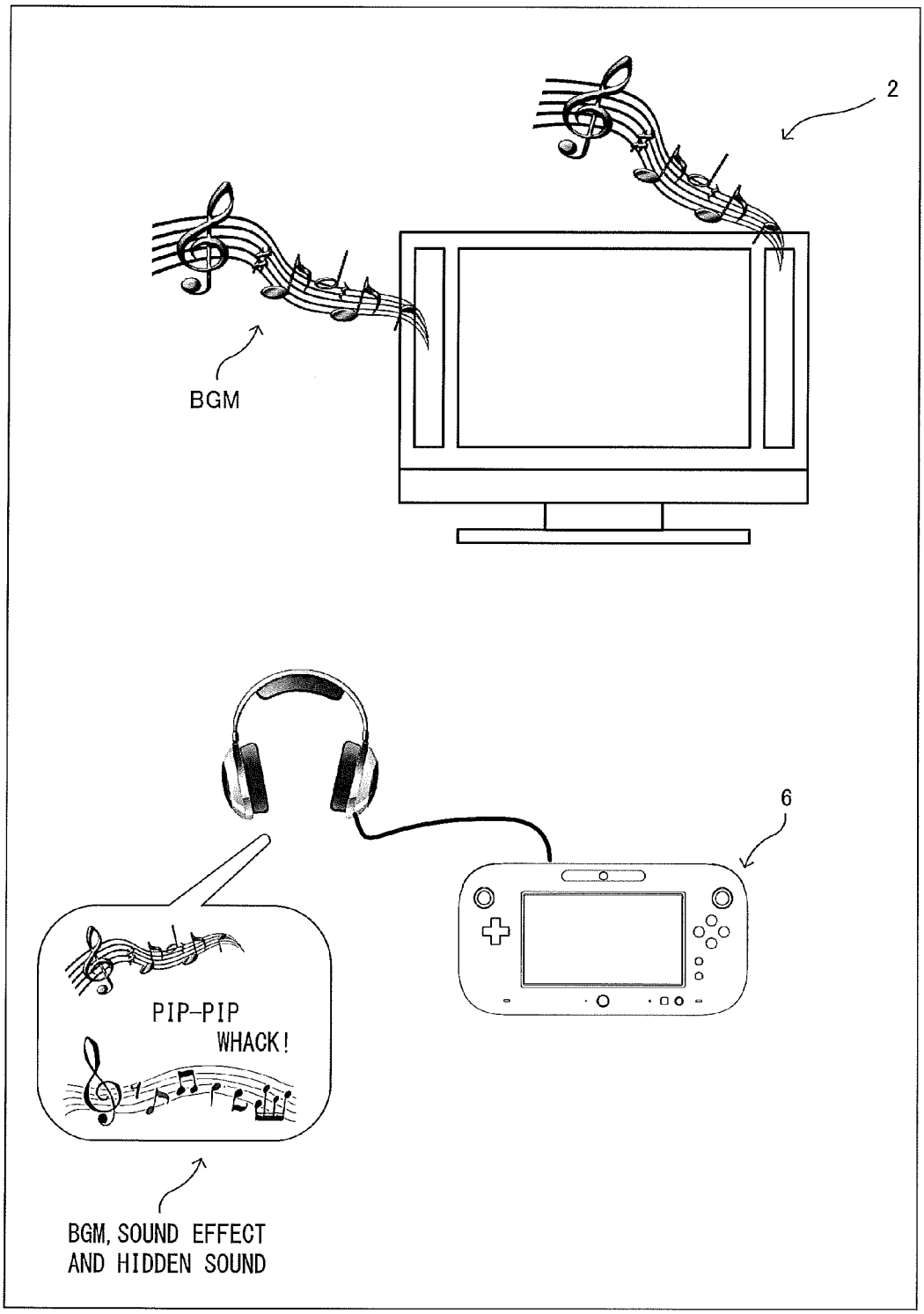
FIG. 14 illustrates a non-limiting exemplary state where a game sound.

In addition, for example, as shown in FIG. 14, a sound that can be heard through headphones, only when the headphones are connected to the terminal device 6, may be outputted. In this case, when the CPU 11 determines that the headphones are connected to the terminal device 6, predetermined BGM or a predetermined sound effect that is set as a "hidden sound", is reproduced, and the terminal game sound containing the "hidden sound" may be generated and transmitted. By a game process using such a gimmick being executed, a development of the game can be diversified, to enhance an entertaining characteristic of the game.

Furthermore, the game process program for executing the process according to the exemplary embodiment, can be stored in any computer-readable storage medium (for example, a flexible disk, a hard disk, an optical disc, a magneto-optical disk, a CD-ROM, a CD-R, a magnetic tape, a semiconductor memory card, a ROM, a RAM, or the like).

Furthermore, although in the exemplary embodiment a game process is described as an exemplary process, a content of the information processing is not limited to the game process, and the process according to the exemplary embodiment is applicable to information processing other than the game.

In the exemplary embodiment, a single apparatus (the game apparatus body 5) executes a series of processes for changing a content of the terminal game sound according to whether or not headphones are connected. However, in another exemplary embodiment, the series of processes may be executed by an information processing system including a plurality of information processing apparatuses. For example, in an information processing system including the game apparatus body 5, and a server-side device capable of communicating with the game apparatus body 5 via a network, a part of the series of processes may be executed by the server-side device. Moreover, in the information processing system described above, the server-side system includes a plurality of information processing apparatuses, and processes to be executed on the server side may be shared and executed by the plurality of information processing apparatuses.

What is claimed is:

1. A sound output system comprising an information processing apparatus, a first output device having a first sound outputter, and a second output device having a second sound outputter, the information processing apparatus including a sound generator configured to generate, based on predetermined information processing, a first sound signal to be outputted to the first output device, and a second sound signal that is a sound signal to be outputted to the second output device and has a sound content different from that of the first sound signal, the second output device including:

a headphone connector configured to connect headphones;

a second sound output controller configured to output, from the second sound outputter, a second sound based on the second sound signal, and to output, when the headphones are connected to the headphone connector, the second sound from the headphones; and a connection detector configured to notify the information processing apparatus whether or not the headphones are connected, and the sound generator generating, when the connection detector notifies that the headphones are connected to the second output device, the second sound signal such that at least a part of a first sound based on the first sound signal is contained in the second sound, while the part of the first sound is not contained in the second sound when no headphones are connected, wherein the first sound and the second sound are outputted simultaneously.

2. The sound output system according to claim 1, wherein the sound generator generates the first sound signal based on predetermine music data and generates the second sound signal based on predetermined sound effect data, when no headphones are connected to the second output device, and generates, when the headphones are connected to the second output device, the second sound signal such that at least a part of a sound represented by the predetermined music data is contained in the second sound.

3. The sound output system according to claim 1, wherein the first output device further includes a first display, the second output device further includes a second display, and the information processing apparatus further includes an image generator configured to generate a first image to be displayed on the first display, and a second image to be displayed on the second display.

4. The sound output system according to claim 1, wherein the second output device further includes an operation data generator configured to generate operation data based on an operation performed by a player, and the information processing apparatus further includes a game processor configured to perform a game process based on the operation data.

5. The sound output system according to claim 1, wherein the first sound comprises multiple parts.

6. The sound output system according to claim 5, wherein only a partial set of the multiple parts of the first sound is contained in the second sound when the headphones are connected.

7. A sound output system comprising an information processing apparatus, a first output device having a first sound outputter, and a second output device having a second sound outputter, the information processing apparatus including a sound generator configured to generate, based on predetermined information processing, a first sound signal to be outputted to the first output device, and a second sound signal that is a sound signal to be outputted to the second output device and has a sound content different from that of the first sound signal, the second output device including:

a headphone connector configured to connect headphones;

a second sound output controller configured to output, from the second sound outputter, a second sound based on the second sound signal when no headphones are connected to the headphone connector, and to output, when the headphones are connected to the headphone connector, the second sound only from the headphones; and a connection detector configured to notify the information processing apparatus whether or not the headphones are connected, and the sound generator, when the headphones are connected to the second output device, generating a sound signal such that at least a part of a first sound based on the first sound signal is contained in the second sound, while the part of the first sound is not contained in the second sound when no headphones are connected, and generating a sound signal such that at least a part of the second sound is contained in the first sound, while the part of the second sound is not contained in the first sound when no headphones are connected, wherein the first sound and the second sound are outputted simultaneously.

8. The sound output system according to claim 7, wherein the first sound comprises multiple parts.

9. The sound output system according to claim 8, wherein only a partial set of the multiple parts of the first sound is contained in the second sound when the headphones are connected.

10. A sound output system comprising an information processing apparatus, a first output device having a first sound outputter configured to output a first sound, and a second output device having a second sound outputter configured to output a second sound, the information processing apparatus including a sound generator configured to generate, based on predetermined information processing, a first sound signal to be outputted to the first sound outputter, and a second sound signal that is a sound signal to be outputted to the second sound outputter and has a sound content different from that of the first sound signal, the second output device including:

a headphone connector configured to connect headphones;

a second sound output controller configured to output, from the second sound outputter, the second sound based on the second sound signal when no headphones are connected to the headphone connector, and to output, when the headphones are connected to the headphone connector, the second sound only from the headphones; and a connection detector configured to notify the information processing apparatus whether or not the headphones are connected, and the sound generator generating, when the headphones are connected to the second output device, a sound signal such that a sound that is not contained in the first sound or the second sound outputted when no headphones are connected, is contained in the second sound.

11. An information processing apparatus capable of outputting a sound signal to a first output device having a first sound outputter, and to a second output device having: a second sound outputter; and a headphone connector that connects headphones, the information processing apparatus comprising:

a connection detector configured to determine, by detection, whether or not the headphones are connected to the second output device; and a sound generator configured to generate, based on predetermined information processing, a first sound signal to be outputted to the first output device, and a second sound signal that is a sound signal to be outputted to the second output device and has a sound content different from that of the first sound signal, and the sound generator generating, when the headphones are connected to the second output device, the second sound signal such that at least a part of a first sound based on the first sound signal is contained in a second sound based on the second sound signal, while the part of the first sound is not contained in the second sound when no headphones are connected, wherein the first sound and the second sound are outputted simultaneously.

12. An information processing apparatus capable of outputting a sound signal to a first output device having a first sound outputter, and to a second output device having: a second sound outputter configured to output a second sound; and a headphone connector that connects headphones, the information processing apparatus comprising:

a connection detector configured to determine, by detection, whether or not the headphones are connected to the second output device; and a sound generator configured to generate, based on predetermined information processing, a first sound signal to be outputted to the first output device, and a second sound signal that is a sound signal to be outputted to the second output device and has a sound content different from that of the first sound signal, and the sound generator, when the headphones are connected to the second output device, generating a sound signal such that at least a part of a first sound based on the first sound signal is contained in the second sound, while the part of the first sound is not contained in the second sound when no headphones are connected, and generating a sound signal such that at least a part of the second sound is contained in the first sound, while the part of the second sound is not contained in the first sound when no headphones are connected, wherein the first sound and the second sound are outputted simultaneously.

13. An information processing apparatus capable of outputting a sound signal to a first output device having a first sound outputter configured to output a first sound, and to a second output device having: a second sound outputter configured to output a second sound; and a headphone connector that connects headphones, the information processing apparatus comprising:

a connection detector configured to determine, by detection, whether or not the headphones are connected to the second output device; and a sound generator configured to generate, based on predetermined information processing, a first sound signal to be outputted to the first output device, and a second sound signal that is a sound signal to be outputted to the second output device and has a sound content different from that of the first sound signal, and the sound generator generating, when the headphones are connected to the second output device, a sound signal such that a sound that is not contained in the first sound or the second sound outputted when no headphone are connected, is contained in the second sound.

14. A computer-readable non-transitory storage medium having stored therein an information processing program executed by a computer of an information processing apparatus capable of outputting a sound signal to a first output device having a first sound outputter, and to a second output device having: a second sound outputter; and a headphone connector that connects headphones, the information processing program causing the computer to function as connection detector configured to determine, by detection, whether or not the headphones are connected to the second output device, and sound generator configured to generate, based on predetermined information processing, a first sound signal to be outputted to the first output device, and a second sound signal that is a sound signal to be outputted to the second output device and has a sound content different from that of the first sound signal, and the sound generator generating, when the headphones are connected to the second output device, the second sound signal such that at least a part of a first sound based on the first sound signal is contained in a second sound based on the second sound signal, while the part of the first sound is not contained in the second sound when no headphones are connected, wherein the first sound and the second sound are outputted simultaneously.

15. A computer-readable non-transitory storage medium having stored therein an information processing program executed by a computer of an information processing apparatus capable of outputting a sound signal to a first output device having a first sound outputter, and to a second output device having: a second sound outputter configured to output a second sound; and a headphone connector that connects headphones, the information processing program causing the computer to function as:

connection detector configured to determine, by detection, whether or not the headphones are connected to the second output device; and sound generator configured to generate, based on predetermined information processing, a first sound signal to be outputted to the first output device, and a second sound signal that is a sound signal to be outputted to the second output device and has a sound content different from that of the first sound signal, and the sound generator, when the headphones are connected to the second output device, generating a sound signal such that at least a part of a first sound based on the first sound signal is contained in the second sound, while the part of the first sound is not contained in the second sound when no headphones are connected, and generating a sound signal such that at least a part of the second sound is contained in the first sound, while the part of the second sound is not contained in the first sound when no headphones are connected, wherein the first sound and the second sound are outputted simultaneously.

16. A computer-readable non-transitory storage medium having stored therein an information processing program executed by a computer of an information processing apparatus capable of outputting a sound signal to a first output device having a first sound outputter configured to output a first sound, and to a second output device having: a second sound outputter configured to output a second sound; and a headphone connector that connects headphones, the information processing program causing the computer to function as connection detector configured to determine, by detection, whether or not the headphones are connected to the second output device, and sound generator configured to generate, based on predetermined information processing, a first sound signal to be outputted to the first output device, and a second sound signal that is a sound signal to be outputted to the second output device and has a sound content different from that of the first sound signal, and the sound generator generating, when the headphones are connected to the second output device, a sound signal such that a sound that is not contained in the first sound or the second sound outputted when no headphones are connected, is contained in the second sound.

17. A control method for controlling one of an information processing apparatus and an information processing system capable of outputting a sound signal to a first output device having a first sound outputter, and to a second output device having: a second sound outputter; and a headphone connector that connects headphones, the control method comprising:

determining, by detection, whether or not the headphones are connected to the second output device; and generating, based on predetermined information processing, a first sound signal to be outputted to the first output device, and a second sound signal that is a sound signal to be outputted to the second output device and has a sound content different from that of the first sound signal, in the generating step, the second sound signal being generated, when the headphones are connected to the second output device, such that at least a part of a first sound based on the first sound signal is contained in a second sound based on the second sound signal, while the part of the first sound is not contained in the second sound when no headphones are connected, wherein the first sound and the second sound are outputted simultaneously.

18. A control method for controlling one of an information processing apparatus and an information processing system capable of outputting a sound signal to a first output device having a first sound outputter, and to a second output device having: a second sound outputter configured to output a second sound; and a headphone connector that connects headphones, the control method comprising:

determining, by detection, whether or not the headphones are connected to the second output device; and generating, based on predetermined information processing, a first sound signal to be outputted to the first output device, and a second sound signal that is a sound signal to be outputted to the second output device and has a sound content different from that of the first sound signal, in the generating step, a sound being generated when the headphones are connected to the second output device such that at least a part of a first sound based on the first sound signal is contained in the second sound, while the part of the first sound is not contained in the second sound when no headphones are connected, and generating a sound signal such that at least a part of the second sound is contained in the first sound, while the part of the second sound is not contained in the first sound when no headphones are connected, wherein the first sound and the second sound are outputted simultaneously.

19. A control method for controlling one of an information processing apparatus and an information processing system capable of outputting a sound signal to a first output device having a first sound outputter configured to output a first sound, and to a second output device having: a second sound outputter configured to output a second sound; and a headphone connector that connects headphones, the control method comprising:

determining, by detection, whether or not the headphones are connected to the second output device; and generating, based on predetermined information processing, a first sound signal to be outputted to the first output device, and a second sound signal that is a sound signal to be outputted to the second output device and has a sound content different from that of the first sound signal, in the generating step, a sound being generated, when the headphones are connected to the second output device, such that a sound that is not contained in the first sound or the second sound outputted when no headphones are connected, is contained in the second sound.

* * * * *

UNITED STATES PATENT AND TRADEMARK OFFICE

CERTIFICATE OF CORRECTION

PATENT NO. : 9,277,340 B2
APPLICATION NO. : 13/868450
DATED : March 1, 2016
INVENTOR(S) : Masato Mizuta It is certified that error appears in the above-identified patent and that said Letters Patent is hereby corrected as shown below:

Title Page, (73) Assignee delete "NINTENDO CO., LTC.," and insert -- NINTENDO CO., LTD., -- before -- Kyoto (JP) --

Signed and Sealed this
Thirty-first Day of May, 2016

Michelle K. Lee

Michelle K. Lee
*Director of the United States Patent and Trademark Office*